United States Patent [19]

Josey, Jr. et al.

[11] Patent Number: 4,813,145

[45] Date of Patent: Mar. 21, 1989

[54] AUTOMATICALLY RETRACTING CHALK LINE ASSEMBLE

[76] Inventors: Archie B. Josey, Jr.; Timothy C. Sox, both of Jacksonville, Fla.

[21] Appl. No.: 233,463

[22] Filed: Aug. 18, 1988

[51] Int. Cl.[4] ..... B44D 3/38

[52] U.S. Cl. ..... 33/414; 33/756; 242/107.3

[58] Field of Search ..... 33/138, 414, 413; 242/107.3, 107.6, 107.12, 107.5

[56] References Cited

U.S. PATENT DOCUMENTS 1,272,270 7/1918 Jarvio ..... 33/414

3,289,969 12/1966 Purbaugh ..... 242/107.3

4,192,078 3/1980 Lore et al. ..... 33/414

4,765,557 8/1988 Kahmann ..... 33/414 X

*Primary Examiner*—Harry N. Haroian

*Attorney, Agent, or Firm*—Thomas C. Saitta

[57] ABSTRACT

An automatically retracting chalk line assembly having both locking and braking means to lock the extended line in place and to slow the speed of retraction of the line during automatic rewind. The spool containing the line has an extended side in a hub cap shape which protrudes through a circular aperture in the housing. A slide member is moved out of a channel in this hub cap to form a friction lock with the housing. Braking is accomplished by slowing the spin of the hub cap by hand pressure.

7 Claims, 2 Drawing Sheets

FIG.3
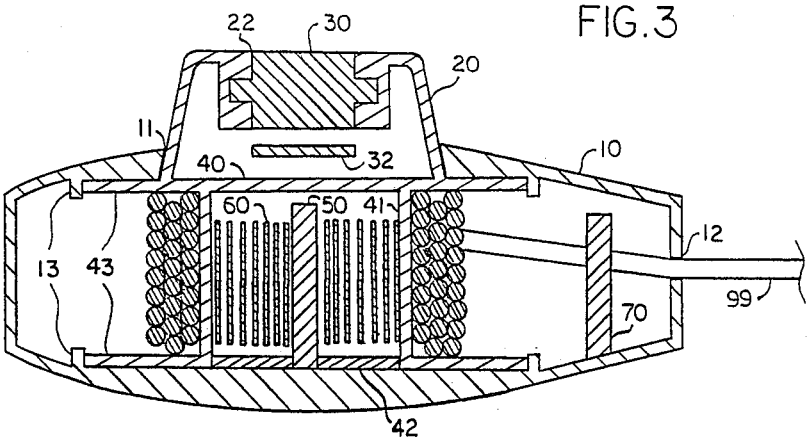
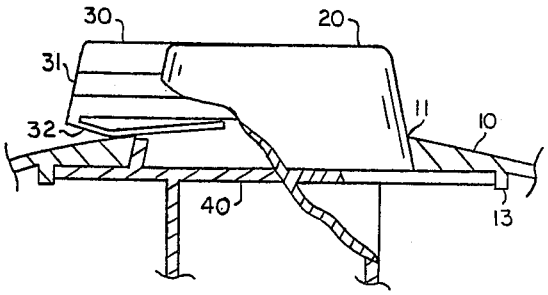
FIG.4

AUTOMATICALLY RETRACTING CHALK LINE ASSEMBLE

BACKGROUND OF THE INVENTION

This invention relates to the field of chalk line assemblies wherein a length of line, enveloped in chalk dust, can be withdrawn from a housing and extended to mark a straight line. The line is then automatically drawn back into the housing without recourse to hand cranking. The typical mechanism involves a coiled spring within the housing which causes the retracting action. Various types of locking mechanisms are used to hold the line in extended position. Many such devices are known in the art.

A well known problem encountered with automatically retracting line assemblies is that the speed of retraction, due to the requirement of having a sufficient amount of stored energy in the coiled spring, is usually greater than desired by the operator for safe retraction of the line. Retracting the line results in a high velocity projectile, the line end piece, snapping back at the operator. This can result in injury to the operator or the device itself.

A review of prior art indicates that various mechanisms have been employed to either lock the line in extended position or to slow the retraction speed. Some mechanisms accomplish both purposes. In this application, for ease of understanding, the terms "lock" or "locking" will be used for mechanisms that hold the extended line in a stationary position. The terms "brake" or "braking" will be used for mechanisms that slow the retraction of the line. In the prior art, the terms are sometimes used interchangeably, so examination of the function is necessary.

Representative locking mechanisms are taught by Gavin in U.S. Pat. No. 627,057, Field in U.S. Pat. No. 845,401, Kiso in U.S. Pat. No. 997,831, Kane in U.S. Pat. No. 3,114,515, Quenot in U.S. Pat. No. 4,121,785, and Karger in U.S. Pat. No. 4,565,011. Gavin teaches a gear tooth lock that mechanically engages teeth on the spool. Field teaches a brake-shoe lever which locks the reel. Kiso uses a ratchet and pawl mechanism which locks the line in extended position. Kane uses an internal leaf spring which frictionally engages the side of the drum and contact is broken by pushing on a central button. Quenot shows a push button lock which causes frictional engagement between the drum and the interior of the button itself. Karger teaches the use of additional internal springs to lock the spool in place. None of the above references teach any mechanism for braking the retraction speed of the line, and the lock mechanisms as taught are not suitable for this purpose.

There are prior patents that teach braking mechanisms or combined braking-locking mechanisms, for example, Chow in U.S. Pat. No. 3,197,155, Petrie in U.S. Pat. No. 2,463,303, Lore et al. in U.S. Pat. No. 4,192,078, and Longenette in U.S. Pat. No. 4,592,148.

Chow shows a device for tightening shoelaces that retracts two lines at once using a coiled spring. The locking part of the device works oppositely from the mechanisms of the chalk line devices, in that the lines are always locked in non-use and the locks are disengaged to both retract and extend the lines. The locks are short rods projecting towards the drum and held in place by springs. Pressing inwardly on the rods releases the lock. Braking is performed by pressing a finger against a protruding pivot shaft, while at the same time pressing both locking rods.

Petrie teaches a reel mechanism that incorporates a friction brake. A disc of material made of leather, rubber, etc. is pushed against side of the spool by a thin metal disc having a central button exposed through the housing. To brake the line during retraction, the user presses the button with his thumb, which in turn presses the material disc against the side of the spool. The greater the pressure, the slower the line is retracted. A locking mechanism consists of a slidable piece which is attached by a rivet to the metal disc, the sliding piece being wedge shaped and, when extended, forcing the metal disc against the material disc. All of these components are contained within the housing, except for the protruding portion of the button.

Lore et al. shows an automatically retracting chalk line assembly that is locked by sliding a tongue against the squared side of the shaft. To brake the retraction, the tongue is only slightly pushed into place, such that the rounded end of said tongue bumps against the rotating corners of the shaft.

Longenette teaches a chalk line assembly where a closed horse-shoe shaped clutch can be pressed against the interior sleeve by action of a slide on the outside of the housing. Progressively sliding the outside slide member varies the amount of braking.

The above described devices all have specific drawbacks which are overcome by this invention. Some of the devices require separate locking and braking mechanisms. They all involve additional parts and constructions, which affect the cost and ease of manufacture, and provide extra sources of mechanical problems for the user. The braking mechanisms all involve frictional contact between parts of the asssembly, so that wear will shorten the effective life of the device in use. Furthermore, any mechanisms which exert pressure against the spool act to deform or misalign the spool with regard to its spindle, causing problems in the retraction efficiency.

This invention provides for an automatically retracting chalk line assembly having a locking/braking mechanism which is an improvement over known prior art. The invention is cheaper and easier to produce, has less parts requiring less assembly, is easier to use in practice and is not subject to wear and mechanical failure.

BRIEF SUMMARY OF THE INVENTION

The invention is similar to existing chalk line assemblies in that it comprises a housing of a size suitable to be hand-held, which contains a length of line wound onto a rotating spool, the line passing through a quantity of chalk dust so that it can be used to make a linear mark when withdrawn. The spool is automatically retracted by action of a coiled spring which is attached to the spool and fixed to the housing, such that extracting the line tightens the coiled spring, the stored energy being then used to rotate the spool to retract the line.

The invention resides in the construction or form of the spool and its relationship to the housing, which creates a novel and unique means for braking and locking the device. The spool is constructed such that it rotates within corresponding annular shoulders on the interior of the housing. The coiled spring is attached to a point on the interior annular wall of the spool and the line is attached to the outer annular wall of the spool. One side of the spool extends outwardly in the axial direction, such that a major portion of the spool side is of an inverted bowl or truncated cone shape. The housing contains a large circular opening which allows the bowl-shaped portion of the spool to extend through this opening. When the line is withdrawn or retracted, the bowl-shaped portion of the spool rotates. The operator can brake the retraction speed of the line by holding the housing in his palm such that the exposed portion of the spool spins next to his palm. To slow the rate of return, the user simply increases the pressure of his palm, i.e., holds the device tighter. The greater the pressure, the slower the retraction. The invention thus requires no extra parts to accomplish braking and because of this, there are no additional parts causing increased wear on components of the device.

To lock the line in the extended position, a simple one-piece slide lock is incorporated into the exposed spool portion. A channel is formed in the bowl-shaped portion of the spool to receive a sliding member. In the unlocked position (during withdrawal or retraction) no portion of the slide lock extends beyond the peripheral configuration of the spool, thereby not interfering with the rotation of same. To lock the spool in place, the sliding member is transversely moved so that it extends beyond the outer circumference of the bowl-shaped spool portion and over a part of the housing itself. The underside of the sliding member is formed as a leaf spring which in its dormant state extends farther in distance than the distance form the underside of the sliding member to the housing. Upon sliding the slide lock member outwardly, the spring is forced against the housing and the pressure against the spring prevents the spool from rotating.

The particulars of the invention will be more fully explained in the following sections. The actual scope of the invention will be as defined in the claims.

BRIEF DESCRIPTION OF THE DRAWINGS

FIG. 3 is a cross-sectional view of the device, taken along line III—III of FIG. 2, showing the internal sructure of the device.

FIG. 4 is a detail of the locking mechanism of the device, shown partly in cross-section and partly in cutaway to best illustrate the features, taken along line IV—IV of FIG. 1, which shows the locking means in extended position.

DETAILED DESCRIPTION OF THE PREFERRED EMBODIMENT

Figure 1:
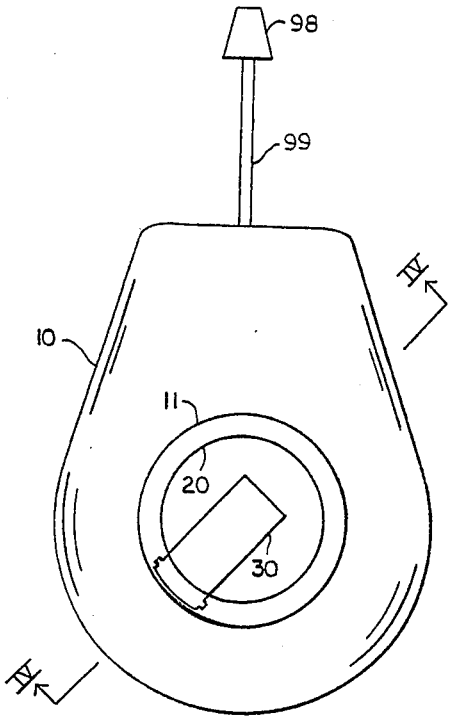
FIG. 1 is an external view of the device, as seen from above.
Figure 2:
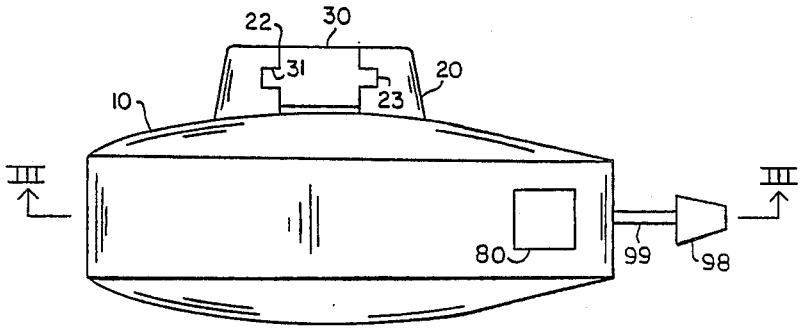
FIG. 2 is an external view of the device as seen from the side.

The overall shape of the invention is best described with reference to FIGS. 1 and 2. As shown, the invention comprises a housing 10 which is preferably formed in a tapering or oblong shape. The housing must be of a size suitable to easily fit within the palm of the operator's hand. A rough size of three inches by five inches and a thickness of one to one and one inches is preferable. In use, the operator holds the device in one hand and withdraws the desired amount of line 99 needed to make the mark. The line 99 is made of a material which is receptive to the adhesion of chalk dust, such as string or twine. The external end of line 99 is attached to an end-piece 98, shown slightly extended, which is used to hold the line for marking and prevents total retraction of the line into the housing 10. The housing 10 is mainly hollow, containing a quantity of chalk dust and various components of the assembly which will be discussed below. In manufacture, the housing 10 is constructed of two separate parts which are then joined after insertion of the internal components.

Extending through housing 10 is hub cap 20. Hub cap 20 is a bowl shaped or truncated cone shaped portion of the side of spool 40. Hub cap 20 can be an integrally formed part of spool 40 or can be an attached piece. Hub cap 20 extends through a circular aperture 11 of housing 10. Preferably, hub cap 20 extends beyond the surface of housing 10 one half to one inch and is from an inch to an inch and one half in diameter across its top. The exposed size of hub cap 20 must be such that the device can be held without the palm impeding the rotation of hub cap 20, while also being of a size such that enough surface contact area is present so that slight pressure of the palm against the hub cap 20 will slow or stop its rotation.

Contained within hub cap 20 is a channel 21 extending to at least one side of hub cap 20. A slide lock member 30 is contained in this channel. As shown in FIG. 2, slide lock member 30 and channel 22 are constructed so that slide lock member 30 can be transversely moved within channel 22, yet cannot be removed in any other direction. This is preferably accomplished by forming slide lock member 30 with longitudinal projection ribs 31, which run the length of slide lock member 30 and fit into corresponding recessions 23 of channel 22. With this construction, slide lock member 30 can be transversely moved within channel 22 so that a portion of slide lock member 30 extends beyond the perimeter of hub cap 20 and over a portion of housing 10. Slide lock member 30 is shaped such that no portion extends beyond the general perimeter configuration of hub cap 20 when the slide lock member 30 is not transversely extended and therefore the slide lock member 30 will not interfere with the rotation of the hub cap 20 when the device is in use during withdrawal or retraction of the line 99. The upper external surfaces of hub cap 20 and slide lock member 30 can be planar or slightly curved, and slide lock member 30 can have slight indentions or ridges to create better contact between its surface and the operator's finger when it is being extended.

Access door 80 provides a means to insert a quantity of chalk dust into housing 10. Access door 80 may be attached using any common method, and can be hinged or fixed within sliding channels.

With reference now to FIG. 3, the internal structure of the device can be detailed. As stated, housing 10 is substantially hollow. Hub cap 20, which is either attached to or is formed as part of spool 40, extends through aperture 11. Slide lock member 30 is contained in channel 22. Housing 10 has two major walls disposed oppositely from one another, one wall containing the circular aperture 11. Extending from the interior of the other major wall is spring post 50. Spring post 50 is fixed to the major wall of housing 10 such that its central axis is aligned with the center of circular aperture 11 in the other major wall of housing 10. Spring post 50 extends a substantial distance into the interior of spool 40, but does not extend through the upper side and into hub cap 20. Spring post 50 can be slotted to receive an end of coiled spring 60, or coiled spring 60 can be attached by suitable fastening means to spring post 50. The other end of coiled spring 60 is attached by suitable fastening means to the interior of annular wall 41 of spool 40. A spool cap 42 has an aperture to allow penetration of spring post 50 and fits into the open side of spool 40 to seal the interior of spool 40 from chalk dust.

Spool 40 has two radially extending lips 43 which, in combination with annular wall 41, form a U-shaped channel. Line 99 is wound around spool 40 within this channel, with one end being attached to the exterior side of annular wall 41 and the other end of line 99 passing by guide piece 70, which can be a post or extended flange of the housing 10, and out a small opening 12 in the nose of housing 10.

While the exterior configuration of the major walls of housing 10 are preferably slightly circular in shape, the interiors are preferably planer to receive the outer sides of the two lips 43 of spool 40. Annular shoulders 13, having an interior circumference matched to the exterior circumference of spool lips 43, maintain spool 40 in proper position and allow it to rotate about a single axis. It would of course also be possible to use spring post 50 as a spindle by extending it into a central aperture in the side of spool 40, in which case the annular shoulders 13 would not be required, however it has been found that the preferred embodiment limits unwanted intrusion or loss of chalk dust and provides a more durable and reliable structure.

Referring now to FIG. 4, the prefered construction of the locking means is shown. Certain elements of the device, such as line 99, coiled spring 60, and spring post 50 are not shown in this drawing for purposes of clarity. Housing 10 and annular shoulders 13 are shown in cross-section while slide lock member 30 and its components are shown as exposed. Hub cap 20 and spool 40 are shown partially in cross-section and partially as exposed.

Once the proper length of line 99 is withdrawn from the device the opertor will usually want to lock the device so that the line 99 will not be automatically retracted. Upon finishing the task, the lock will be released and the line 99 allowed to be automatically retracted back into housing 10 by the stored energy in coiled spring 60. Referring to FIG. 4, the interfitting of spool 40 with the interior wall of housing 10 and the annular shoulders 13 is shown. Hub cap 20 extends through circular aperture 11. In order to lock the spool 40 to prevent the line 99 from being retracted, slide lock member 30 is transversely moved in channel 22 until a significant portion of the main body of slide lock member 30 extends over housing 10. The underside of slide lock member 30 is formed as a flexible leaf spring 32. Leaf spring 32 is formed such that in its dormant or relaxed state, its natural position is at a distance from the main body of slide lock member 30 greater than the distance from the main body of slide lock member to the exterior of housing 10. Thus, as slide lock member 30 is moved out of channel 22 beyond the perimeter of hub cap 20, leaf spring 32 is deformed by housing 10 and pushed out of its natural position. The tension in leaf spring 32 acts as a wedge against the exterior of housing 10, and this tension is of sufficient force to lock the hub cap 20 and spool 40 in place, thereby locking the line 99 in the extended state. In order to allow for automatic retraction of line 99, slide lock member is moved back into channel 22, the leaf spring 32 no longer wedges against housing 10 and the spool is free to rotate. As previously discussed, the size and shape of the hub cap 20 are designed such that they are easily used to brake the retraction rate of line 99. With this structure, no extra braking mechanisms are required.

Preferably all components of this device, with the exception of the coiled spring, are made from a hard plastic. It is of course obvious that suitable materials may be substituted. For instance, the guide piece 70 or the spring post 50 can also be made of metal. It will also be obvious to those skilled in the art that additional features may be added to the device and equivalent means and mechanisms can be obviously substituted for particulars in the above described preferred embodiment. The invention is not to be limited to the descriptions set forth above, but is defined by the following claims.

We claim:

1. A chalk line assembly combined with an automatic retracting line mechanism comprising:

(A) a housing having an open interior space, two major walls, a circular aperture on one major wall, and a closeable access port to allow insertion of a quantity of chalk dust;

(B) a spring post extending from the interior side of the major wall not containing the circular aperture, the axis of the spring post passing through the center of the circular aperture;

(C) a spool, having an annular wall and two radially extending lips forming a U-shaped channel around the circumference of the spool, one side of the spool being open, the other side of the spool comprising a hub cap, being an axially extending bowl shaped wall having a maximum circular perimeter slightly smaller in size than the circular aperture of the housing, such that the hub cap portion of the spool extends through the circular aperture of the housing;

(D) a spool cap adapted to close the opening in the spool, with an aperture to allow the spool cap to fit over the spring post;

(E) a length of line, of a material able to retain an amount of chalk dust by adhesion, having one end attached to the annular wall of the spool and the other end extending out through an opening in the housing and attached to an end-piece, the majority of the line being wound about the spool in the U-shaped channel;

(F) a coiled spring having one end attached to the spring post and the other end attached to the interior of the annular wall of the spool.

2. The device of claim 1, further comprising a slide lock member contained in a channel in the hub cap.

3. The device of claim 2, where the slide lock member comprises a main body portion and a flexible leaf spring, such that the slide lock member can be transversely moved in the channel of the hub cap so that the leaf spring is forced against a portion of the exterior wall of the housing, thereby preventing the spool from rotating.

4. The device of claim 1, further comprising annular shoulders on the interior of each major housing wall to receive the outer edges of the two spool lips.

5. The device of claim 4, further comprising a slide lock member contained in a channel in the hub cap.

6. The device of claim 5, where the slide lock member comprises a main body portion and a flexible leaf spring, such that the slide lock member can be transversely moved in the channel of the hub cap so that the leaf spring is forced against a portion of the exterior wall of the housing, thereby preventing the spool from rotating.

7. In a chalk line assembly having an automatic line retracting mechanism, where a housing contains chalk dust, line for receiving the dust, a spool and a coiled spring; the line being wound onto the rotating spool and the coiled spring operating to retract the line back onto the spool after it has been withdrawn, an improved locking and braking means comprising:

(A) a housing having a circular aperture;

(B) a spool having one wall formed in a bowl shape, such that the circumference of the bowl shaped portion is slightly smaller than the circular aperture in the housing and such that the bowl shaped portion extends through and beyond the housing;

(C) a slide lock member contained in a channel in the bowl shaped poriton of the spool, such that the slide lock member can be transversely moved to extend over the housing, the slide lock member comprising a leaf spring which is thus forcibly contacted with the housing such that the spool cannot rotate.

* * * * *